US006299160B1

(12) United States Patent
Tobin et al.

(10) Patent No.: US 6,299,160 B1
(45) Date of Patent: Oct. 9, 2001

(54) IMPOSITION PROOFING

(75) Inventors: Jeff Tobin, Nashua, NH (US); Robert Bullock, Acton, MA (US)

(73) Assignee: Iris Graphics, Inc., Billerica, MA (US)

( * ) Notice: Subject to any disclaimer, the term of this patent is extended or adjusted under 35 U.S.C. 154(b) by 0 days.

(21) Appl. No.: 09/262,950

(22) Filed: Mar. 4, 1999

(51) Int. Cl.[7] ..... B65H 9/08
(52) U.S. Cl. ..... 271/232; 271/246; 271/273
(58) Field of Search ..... 271/232, 246, 271/245, 273; 347/104

(56) References Cited

U.S. PATENT DOCUMENTS

| | | | | |
|---|---|---|---|---|
| 2,353,902 | | 7/1944 | Johnson | 271/168 |
| 3,360,258 | | 12/1967 | Nix | 462/55 |
| 3,637,203 | * | 1/1972 | French | 271/246 |
| 4,260,248 | | 4/1981 | Murata et al. | 355/60 |
| 4,561,646 | * | 12/1985 | Ellis et al. | 271/232 X |
| 5,263,705 | * | 11/1993 | Schmaling | 271/246 |
| 5,566,933 | * | 10/1996 | Salancy | 271/246 X |
| 5,810,494 | | 9/1998 | Menard et al. | 400/634 |
| 5,924,227 | | 7/1999 | Sommers | 40/360 |
| 5,945,179 | | 8/1999 | Gautreneau | 428/14 |
| 6,016,752 | | 1/2000 | Harari | 101/486 |
| 6,093,447 | | 7/2000 | Johnson et al. | 427/146 |
| 6,140,406 | | 10/2000 | Schliesman et al. | 524/93 |
| 6,169,557 | * | 1/2001 | Suzuki et al. | 347/104 |

FOREIGN PATENT DOCUMENTS 11-91253 4/1999 (JP) .

OTHER PUBLICATIONS

Stephen F. Pond, Ph.D., "Inkjet Technology," Torrey Pines Research, pp. 211–225, 2000.
Staples, Late Winter 2001 Catalog, pp. 5–11, 2001.

* cited by examiner

*Primary Examiner*—David H. Bollinger
(74) *Attorney, Agent, or Firm*—Kristofer E. Elbing

(57) ABSTRACT

An imposition printer and associated method. The printer can disengage its rollers from a print substrate feed path, deploy a pair of registration stops, and align a print substrate by engaging the print substrate with the stops. The rollers can then engage the substrate in an aligned position, and the registration stops can be retracted. After they are engaged, the same rollers can advance the substrate as a deposited ink drop print head deposits ink on it.

21 Claims, 5 Drawing Sheets

IMPOSITION PROOFING

FIELD OF THE INVENTION

This invention relates to imposition proofing and printing stock for imposition proofing.

BACKGROUND OF THE INVENTION

High volume printing of books, brochures, and other multi-page documents typically involves imposition. Imposition is the process of laying out the pages of a document such that they are in numerical order after a larger printed sheet, known as a signature, has been folded into multiples of four pages that make up a section of the document. Before printing the signatures with high-volume, double-sided printers, it is common practice to print a set of proofs using an imposition proofing printer.

Imposition proofing printers are typically relatively large, single-sided, tractor-fed, ink-jet printers. These printers first print one side of a signature on a large sheet of tractor-fed paper. An operator then turns the paper over and threads it back onto the printer's tractor feed mechanism so that the printer can print the other side.

SUMMARY OF THE INVENTION

In one general aspect, the invention features an deposited ink drop imposition proofing print sheet that includes a first rectangular deposited ink drop printable face having a periphery defined by an ordered series of first, second, third, and fourth edges of the imposition proofing print sheet, the first face including an added deposited ink drop print-enhancing composition and a second rectangular deposited ink drop printable face opposite the first face. The second face also has a periphery defined by the first, second, third, and fourth edges of the imposition proofing print sheet and includes an added deposited ink drop print-enhancing composition. The sheet defines a first registration opening located closer to the first sheet edge than to the third sheet edge and closer to the second sheet edge than to the fourth sheet edge. The sheet also defines a second registration opening located closer to the first sheet edge than to the third sheet edge and closer to the fourth sheet edge than to the second sheet edge.

In preferred embodiments, the width of the second registration opening can be greater than the width of the first registration opening, in a direction parallel to the first edge of the imposition proofing sheet. The width of the second registration opening can exceed the width of the first registration opening by about the range of dimensional change with humidity of the sheet between the first and second registration openings in a direction parallel to the first edge of the imposition proofing sheet. The sheet can define the first registration and second registration openings as openings that begin at the first sheet edge. The first and third edges can be at least 42 inches in length, with the second and third edges being at least 30 inches in length and with the first and second registration openings being peripheral to a 42 inch×30 inch printable area of the sheet. The first and second registration openings can be rectangular, and the first and second faces can be coated with the deposited ink drop print-enhancing composition.

In another general aspect, the invention features an imposition proofing printer that includes at least one feed roller located along a printing substrate feed path and having an axis of rotation, at least one pinch roller located along the printing substrate feed path and having an axis of rotation parallel to the axis of rotation of the feed roller, and a disengagement mechanism linked to one or more of the feed roller and the friction feed drum. A first retractable registration pin has an alignment surface located along the printing substrate feed path, and a second retractable registration pin has an alignment surface located along the printing substrate feed path and being spaced from the first retractable registration pin in at least a direction parallel to the axis of rotation of the feed roller. In preferred embodiments, the imposition proofing printer can further include a mechanism linking the first and second retractable stops and the disengagement linkage. The substrate feed path can be at least 30 inches wide.

In a further general aspect, the invention features an imposition printing method that includes the steps of disengaging rollers from a print substrate feed path, deploying a pair of registration stops in the print substrate feed path, aligning a print substrate in the print substrate feed path by engaging openings in the print substrate with respective ones of the pair of stops, engaging the rollers with the print substrate, and retracting the registration stops from the print substrate feed path. In preferred embodiments, the steps of disengaging and deploying can take place in unison, with the steps of engaging and retracting deploying take place in unison. The step of aligning can align a print substrate with registration openings of different widths, and the width of a second of the registration openings can exceeds a width of a first of the registration openings by about the range of dimensional change with humidity of the printing substrate between the first and second registration openings.

Embodiments according to the invention may be advantageous in that they simplify the loading of imposition sheets in an imposition proofing printer while retaining a high level of precision at different humidity levels. The shape and position of the registration openings can permit the user to quickly and reliably align a sheet in a printer's feed path, and linking of stop deployment and roller disengagement mechanisms can further simplify this operation. The alignment can therefore take place quickly and easily without requiring the operator to thread a number of holes onto a tractor feed mechanism. The shape and position of the registration openings also allows the alignment to take place independent of variations in ambient humidity. As a result, humidity-based errors can be reproducibly accounted for, and their effects minimized.

DESCRIPTION OF AN ILLUSTRATIVE EMBODIMENT

Figure 1A:
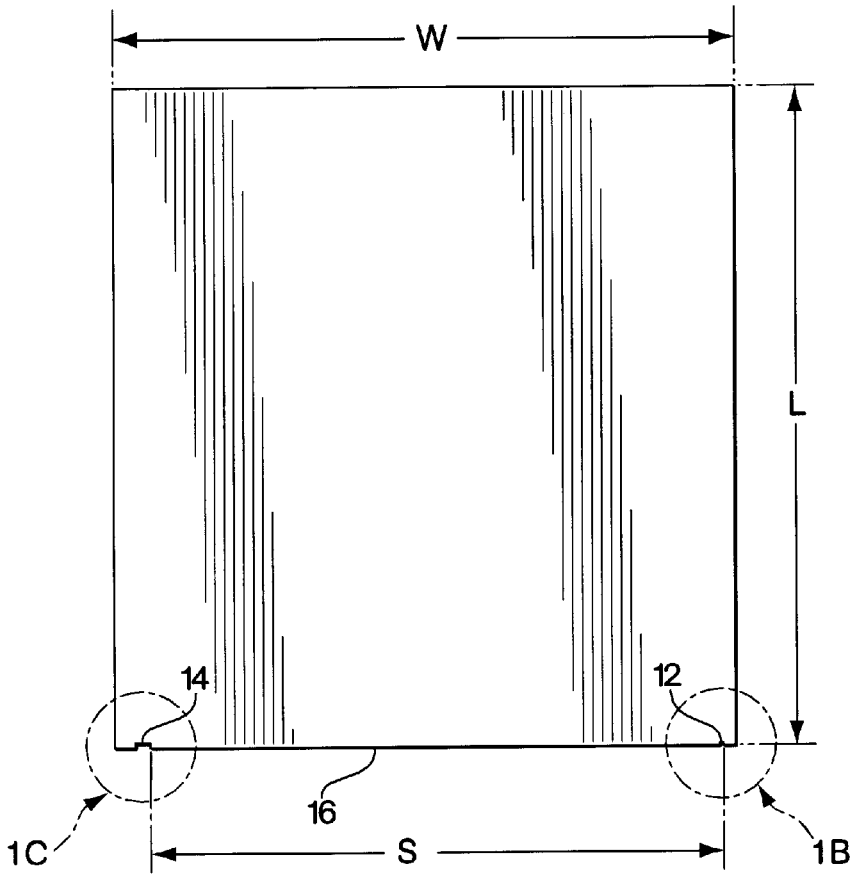
FIG. 1A is a plan view of a printable sheet according to the invention.
Figure 1B:
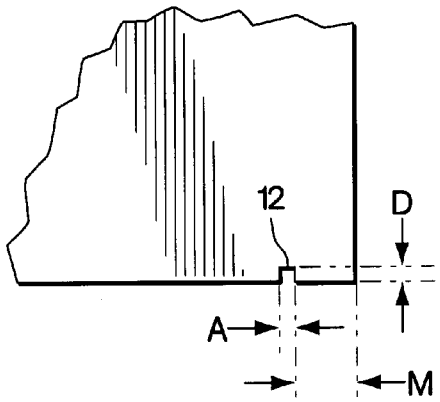
FIG. 1B is an enlarged view of a first corner portion of the printable sheet of FIG. 1A showing a first alignment opening.
Figure 1C:
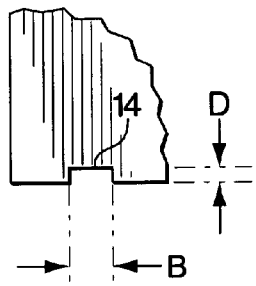
FIG. 1C is an enlarged view of a second corner portion of the printable sheet of FIG. 1A showing a second alignment opening.

Referring to FIGS. 1A–1C, a printable sheet 10 according to the invention is a foursided rectangular sheet having a first registration opening 12 and a second registration opening 14. The sheet is made up of a printable area and a series of margin areas, which include the registration openings. In one embodiment, the sheet has a length L of 35 inches and a width W of 42 inches, with a 42×30 inch printable area. These dimensions are beneficial in that they allow proofs to be printed for a large number of imposition printing applications.

The registration openings 12, 14 are positioned to prevent rotation of the sheet 10 relative to a print head path, and are preferably located at the leading edge 16 of the sheet. They can be open-ended openings cut out of the leading edge, or they can be closed-ended holes proximate the leading edge. The separation S between the registration openings is preferably as large as possible, consistent with margins M that define the openings. This large separation helps to reduce any misalignment due to dimensional errors in the openings.

The registration openings preferably have different widths. The width A of the first opening 12 preferably matches the width of one of two identical and symmetrically disposed registration stops (see FIG. 2), while the width B of the second opening 14 is greater than the width of the stops. This difference allows the sheet to reliably interact with the stops despite differences in humidity that result in expansion and contraction of the sheet. Specifically, the width of the second opening should exceed the width of the first by at least the range of dimensional change that results from changes in humidity under normal operating conditions. Typical dimensional change numbers for paper of the general type used in imposition printing are:

50% to 20%RH–0.1% in the cross grain direction

50% to 20%RH–0.06% in the grain direction

50% to 80%RH+0.25% in the cross grain direction

50% to 80%RH+0.06% in the grain direction

In one embodiment, the first opening is 0.25 inches wide and the second is 0.75 inches wide to accommodate a +/−0.25 inch expansion specification for a normal humidity range of 20% to 80%. A 0.5 inch wide second opening is also contemplated for typical imposition applications. Both openings have a depth D of 0.25 inches.

The faces of the sheet should both be printable using deposited ink drops, such as by inkjet printing or deposit on demand printing. To this end, the faces can be coated with one or more compositions that enhance the holding of ink, improve the take up of solvent, and/or prevent excessive bleeding on either face or from face to face. The compositions can also be added to the sheet material (e.g., paper) to produce a uniform sheet with deposited ink drop printable characteristics. Anti-cockle agents can also be added to prevent cockling, a repetitive buckling effect, in areas of dense printing. Coatings that prevent solvent from reaching the paper they are applied to are particularly useful in imposition printing applications, because they prevent ink from causing the paper to expand during printing of a first side, resulting in misalignment of the print on the other side. Suitably prepared paper is available, for example, from Dupont.

Figure 2:
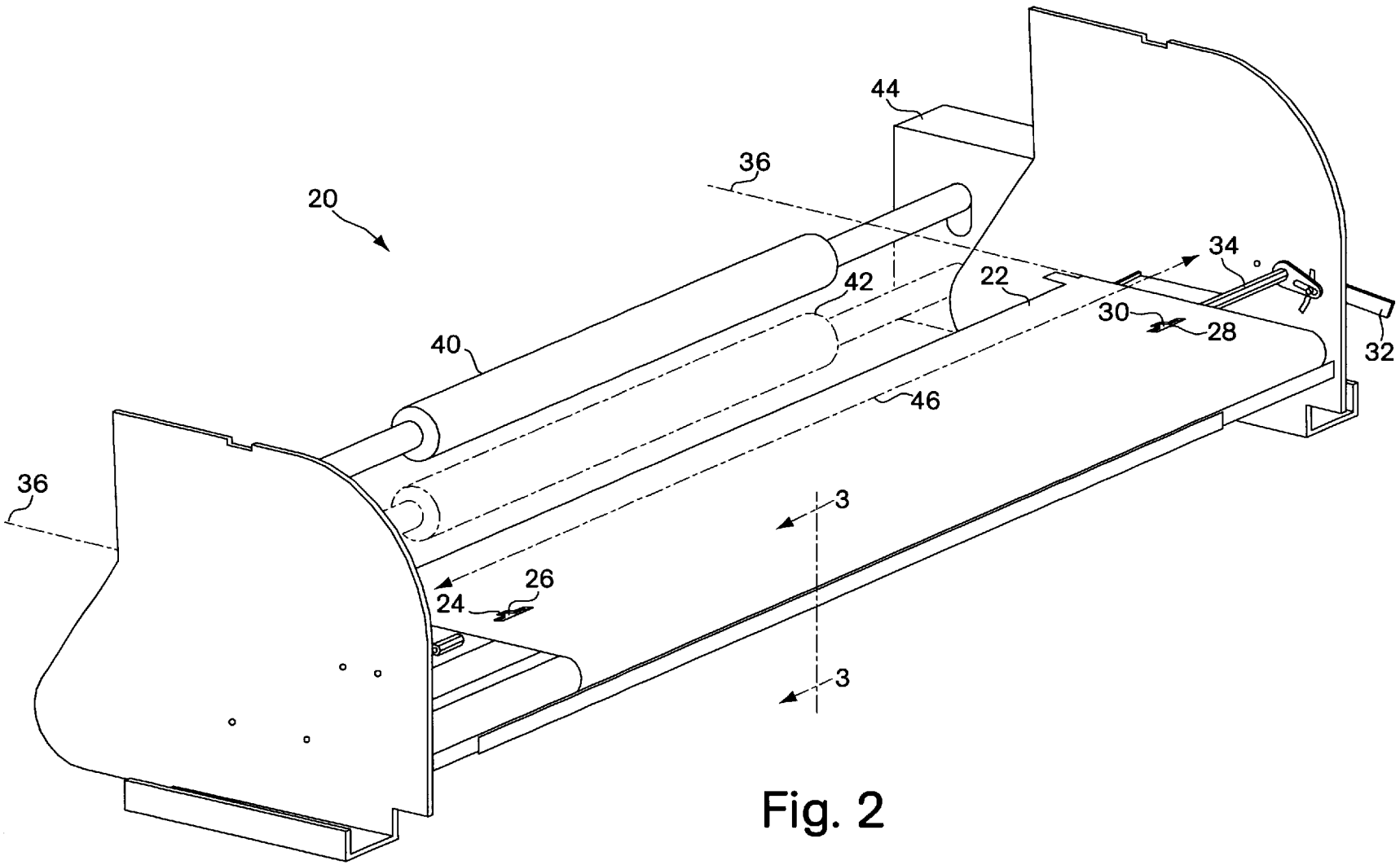
FIG. 2 is a diagrammatic isometric view of a printer feed mechanism according to the invention for printing on the sheet of FIG. 1A.

Referring to FIGS. 1A–2, a printer feed mechanism 20 includes a platen surface 22 with a first hole 24 through which a first registration stop 26 protrudes and a second hole 28 through which a second alignment stop 30 protrudes. The centers of the stops are separated by the nominal separation of the registration openings in the printable sheet at the middle of the humidity range (e.g., 50% humidity), and are slightly offset from a centerline of a feed path 36 to make up for the difference in the widths of the registration openings. A pivoting load lever 32 is connected to a hexagonal shaft 34 that runs under the platen surface. As is conventional, the platen has holes in it to allow a vacuum in a chamber beneath the platen to help hold the sheet in place over the platen.

Further along the feed path 36 of the printer there is a roller assembly that can be made up of at least one feed roller 40, at least one pinch roller 42, and a disengagement mechanism 44. A number of different types of rollers and disengagement mechanisms are suitable for use with the invention. For example, the rollers can be elastomeric rollers with a resilient, tacky surface, or they can be diamond-coated steel rollers with a fine grit surface. There can be more than one shaft for feed rollers and/or pinch rollers, and each shaft may bear more than one roller. Suitable roller mechanisms are available on printers manufactured by Hewlett-Packard, Calcomp, Mutoh, and other manufacturers. A print head path 46 for a swathing deposited ink drop print head is located between the platen 22 and the roller assembly.

Figure 3:
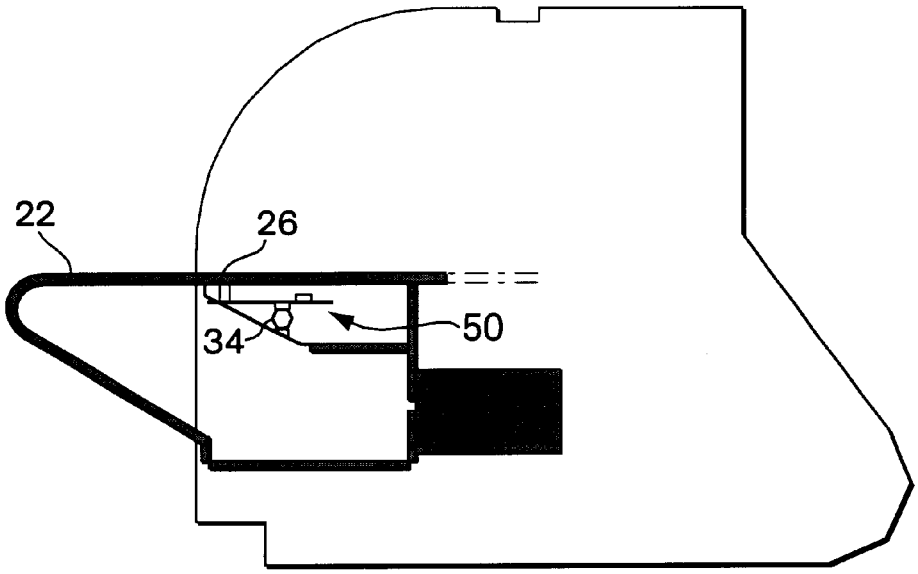
FIG. 3 is a cross section of the feed mechanism of FIG. 2 along the line labeled 3—3 in FIG. 1.

Referring to FIGS. 2–3, the first registration stop 26 is part of a first spring-loaded pivoting registration stop rocker 50. This rocker includes a bearing surface which is pressed onto the hexagonal shaft 34 by a spring, such that rotation of the shaft by the load lever 32 lifts the first registration stop up through the first hole 24. The second registration stop 30 forms part of a second spring loaded pivoting registration stop rocker, which is similarly situated with respect to the hexagonal shaft.

Figure 4:
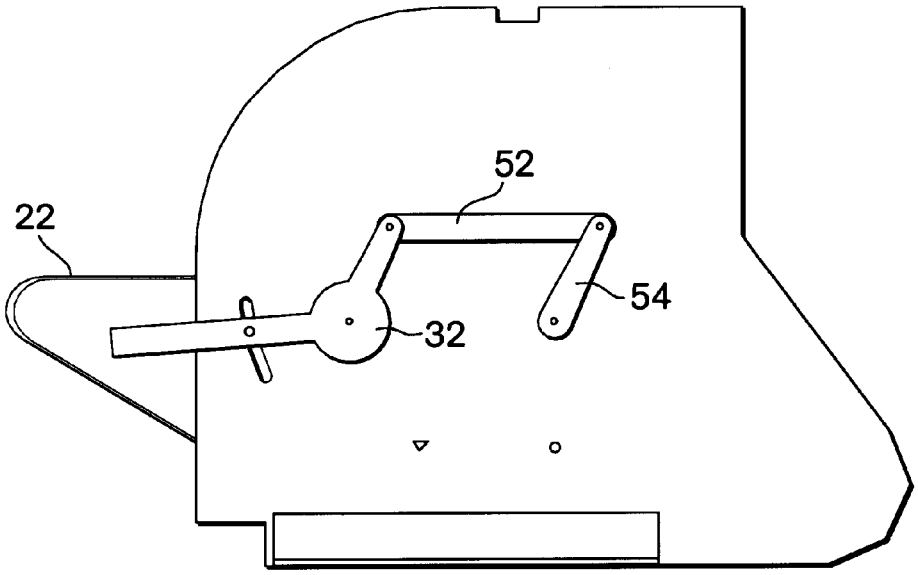
FIG. 4 is an end view of the feed mechanism of FIG. 2.
Figure 5:
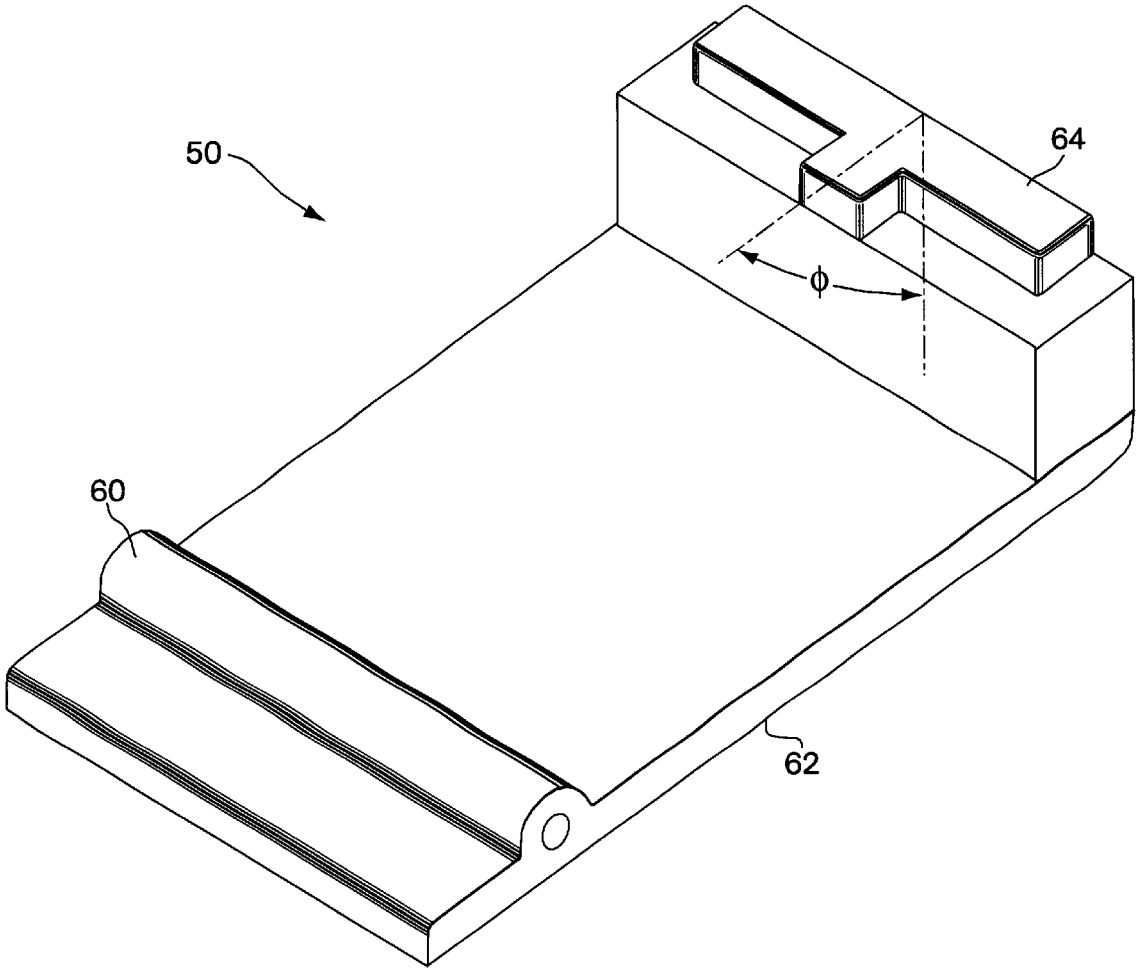
FIG. 5 is an isometric view of a first stop rocker for the printer feed mechanism of FIG. 2.
Figure 6:
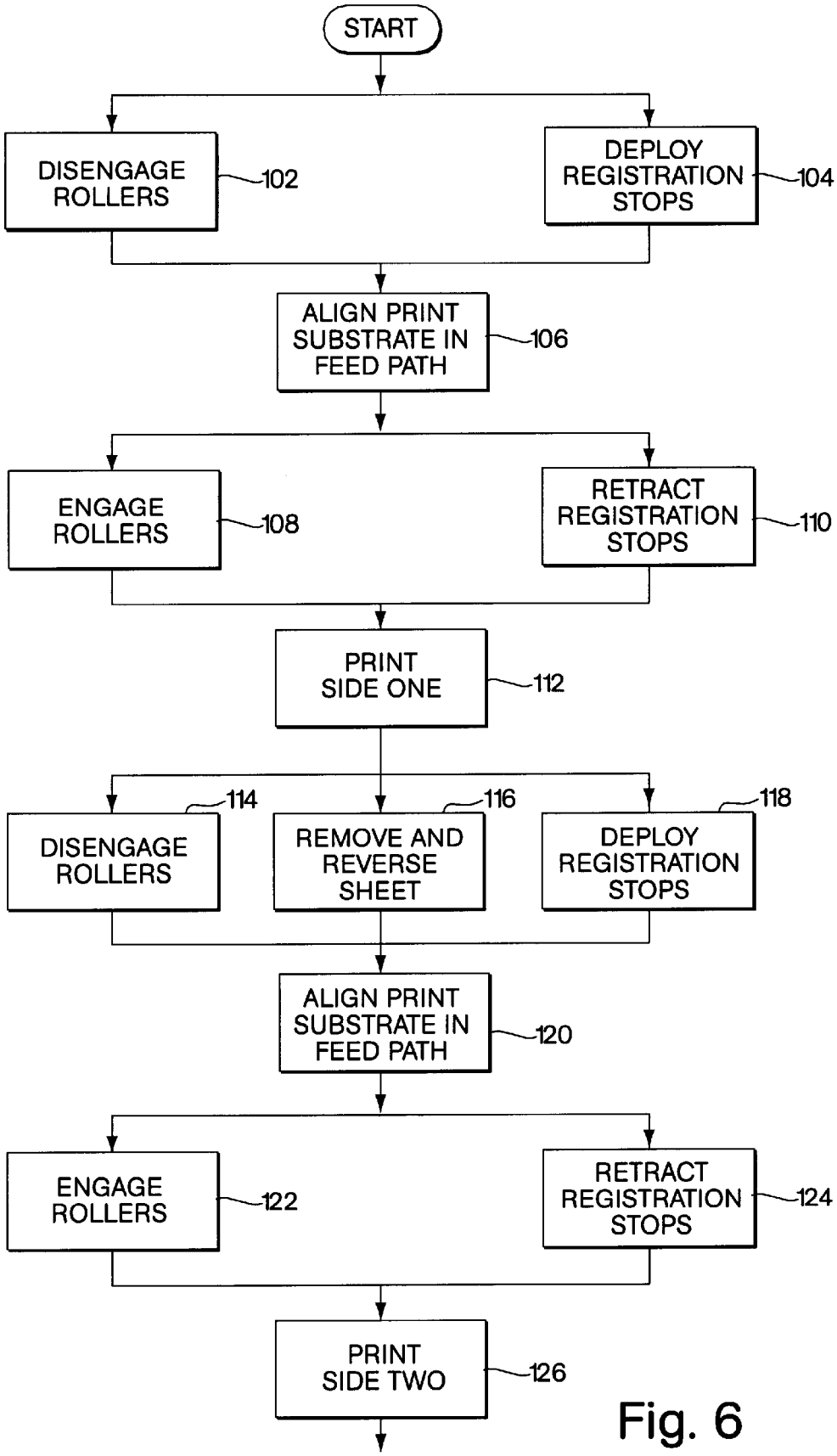
FIG. 6 is a flowchart illustrating a two-sided printing operation on the sheet of FIGS. 1A–1C using the feeding mechanism of FIG. 2.

Referring to FIG. 4, the roller disengagement mechanism 44 can be linked to the stop retraction mechanism. The link between the two mechanisms can take on a number of forms, such as linkages, belts, gears, or any other suitable mechanism. The two mechanisms can also be driven by solenoids and sequenced electronically, such as by a microprocessor.

In one embodiment, the roller disengagement mechanism includes a second hexagonal shaft that separates the rollers by a cam action, similar to the cam action that engages and disengages the stops. In this embodiment, the two hexagonal shafts are linked by a four-bar linkage made up of a portion of the handle 32, a linking member 52, and a radial member 54 attached to the second hexagonal shaft.

Referring to FIGS. 1A, 1B, 1C, and 5, the stop rocker 50 includes a pivot 60, a bearing surface 62, and a stop 64. In one embodiment, the stop is T-shaped with the trunk of the "T" facing toward the roller mechanism. This protrusion is slightly smaller than the first registration opening 12 in the printable sheet 10, so that the two engage readily. The rear stop area formed by the underside of the top of the "T" is the surface against which the portions on either side of the leading edge surrounding the registration openings of the sheet butts. It should be just wide enough to hold the paper under all rated humidity conditions. For example, where the smaller registration opening is a 0.25 inch square, all of the segments of the "T" in the registration stop can be 0.22 inches wide, with the trunk of the "T" being a 0.22 inch square and the top of the "T" being I to 1.25 inches long overall. The top surface of the stop slopes downward toward the roller mechanism when it is engaged (e.g., sloped by an angle Ø of about 85 degrees from vertical). This slope helps to prevent the sheet from becoming caught on the leading edge of the stop or the trailing edge of its hole as it is advanced by the rollers.

Referring to FIGS. 1–6, imposition printing on a printable sheet 10 using the printer feed mechanism 20 will now be described. Before inserting a printable sheet, the feed mechanism disengages the feed and/or pinch rollers (step 102). This can take place in response to actuation of the user of a mechanical lever or in response to an electrical signal.

The feed mechanism also deploys the registration stops 26, 30 (step 104). This operation can occur simultaneously with the disengagement of the roller mechanism (step 102), such as may take place where the mechanism is mechanically linked, or at least in unison (i.e., in a coordinated, but not necessarily simultaneous, fashion) with the disengagement of the roller mechanism, such as may take place when the two operations are sequenced by a microprocessor. The two operations can also proceed independently, in any order.

The operator then inserts the printable sheet into the feed mechanism and butts the ends of the registration openings up against the ends of the registration stops to align the sheet in the feed path (step 106). The feed mechanism then engages the rollers (step 108) and retracts the stops (step 110). These two operations can take place simultaneously, in unison, or independently, although it appears to be preferable to engage the vacuum hold through the platen before engaging the rollers and to retract the stops after engaging the rollers. With the rollers engaged, the printer can employ its optical sensors to determine the positions of the edges of the paper, and then begin printing on the first side of the sheet, as the rollers feed the sheet back out of the feeding mechanism over the retracted stops (step 112).

Once the first side has been fully printed, the rollers are disengaged (step 114), the sheet is removed and reversed (step 116), and the stops are deployed (step 118). Some or all of these operations can occur simultaneously, in unison, or independently. For example, the sheet may be removed from the printer after the rollers are disengaged, which takes place simultaneously with the deployment of the stops.

The operator initiates printing of the second side by inserting the printable sheet into the feed mechanism and butting the ends of the registration openings up against the ends of the registration stops to align the sheet in the feed path (step 120). The feed mechanism again engages the rollers (step 122) and retracts the stops (step 124) either simultaneously, in unison, or independently. With the rollers engaged, the printer can begin printing of the second side of the sheet (step 126). The process can then be repeated for further sheets.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto. In addition, the order of presentation of the claims should not be construed to limit the scope of any particular term in the claims.

What is claimed is:

1. An imposition proofing printer, comprising:

at least one feed roller located along a printing substrate feed path and having an axis of rotation, at least one pinch roller located along the printing substrate feed path and having an axis of rotation parallel to the axis of rotation of the feed roller, a disengagement mechanism linked to one or more of the feed roller and the pinch roller, a first retractable registration stop having an alignment surface located along the printing substrate feed path, a second retractable registration stop having an alignment surface located along the printing substrate feed path and being spaced from the first retractable registration stop in at least a direction parallel to the axis of rotation of the feed roller, and a print head path for a deposited ink drop print head located along the printing substrate feed path on the same side of the first and second registration stops as the feed roller and the pinch roller.

2. The imposition proofing printer of claim 1 further including a mechanism linking the first and second retractable stops and the disengagement linkage.

3. The imposition proofing printer of claim 1 herein the substrate feed path is at least 30 inches wide.

4. The imposition proofing printer of claim 1 wherein the print head path is located between the registration stops and the feed roller.

5. An imposition printing method, comprising the steps of:

disengaging rollers from a print substrate feed path, deploying a pair of registration stops in the print substrate feed path, aligning a print substrate in the print substrate feed path by engaging the print substrate with respective ones of the pair of stops, engaging the rollers with the print substrate in an aligned position resulting from the step of aligning, retracting the registration stops from the print substrate feed path, and advancing the print substrate using the rollers as a deposited ink drop print head deposits ink on a first face of the print substrate.

6. The method of claim 5 wherein the steps of disengaging and deploying take place in unison, and wherein the steps of engaging and retracting take place in unison.

7. The method of claim 5 wherein the step of aligning aligns a print substrate with registration openings of different widths.

8. The method of claim 7 wherein the width of a second of the registration openings exceeds a width of a first of the registration openings by about the range of dimensional change with humidity of the printing substrate between the first and second registration openings.

9. The method of claim 5 further including the steps of again disengaging the rollers from the print substrate feed path, again deploying a pair of registration stops in the print substrate feed path, again aligning the print substrate in the print substrate feed path, but this time by engaging the print substrate with opposite ones of the pair of stops with respect to those with which they were engaged in the step of aligning, again engaging the rollers with the print substrate, again retracting the registration stops from the print substrate feed path, and again advancing the print substrate using the rollers, but this time as a deposited ink drop print head deposits ink on a second face of the print substrate.

10. The method of claim 9 wherein the steps of disengaging and deploying take place in unison, wherein the steps of engaging and retracting take place in unison, wherein the steps of again disengaging and again deploying take place in unison, and wherein the steps of again engaging and again retracting take place in unison.

11. The method of claim 9 wherein the steps of aligning and again aligning align a same print substrate with a pair of registration openings.

12. The method of claim 9 wherein the steps of aligning and again aligning align a same print substrate with registration openings of different widths.

13. The method of claim 5 wherein the step of aligning aligns a same print substrate with a pair of registration openings.

14. An imposition proofing printer, comprising:

at least one feed roller located along a printing substrate feed path and having an axis of rotation, at least one pinch roller located along the printing substrate feed path and having an axis of rotation parallel to the axis of rotation of the feed roller, a disengagement mechanism linked to one or more of the feed roller and the pinch roller, a first retractable registration stop having an alignment surface located along the printing substrate feed path, a second retractable registration stop having an alignment surface located along the printing substrate feed path and being spaced from the first retractable registration stop in at least a direction parallel to the axis of rotation of the feed roller, and a print head path for a deposited ink drop print head located along the printing substrate feed path, wherein the substrate feed path is at least about 30 inches wide and wherein the print head path is within at least about 30 inches of at least one of the feed roller and the pinch roller.

15. The imposition proofing printer of claim 14 wherein the print head path is located between the registration stops and the feed roller.

16. The imposition proofing printer of claim 14 further including a mechanism linking the first and second retractable stops and the disengagement linkage.

17. An imposition proofing printer, comprising:

means for disengaging rollers from a print substrate feed path, means for deploying a pair of registration stops in the print substrate feed path, means for aligning a print substrate in the print substrate feed path by engaging the print substrate with respective ones of the pair of stops, means for engaging the rollers with the print substrate, means for retracting the registration stops from the print substrate feed path, and means for advancing the print substrate using the rollers as a deposited ink drop print head deposits ink on the print substrate.

18. The imposition proofing printer of claim 17 wherein the means for disengaging and the means for deploying are constructed and adapted to operate in unison and wherein the means for engaging and the means for retracting are constructed and adapted to operate in unison.

19. The imposition proofing printer of claim 17 wherein the substrate feed path is at least 30 inches wide.

20. The imposition proofing printer of claim 17 wherein the means for aligning align a same print substrate with a pair of registration openings.

21. The imposition proofing printer of claim 17 wherein the means for aligning align a same print substrate with registration openings of different widths.

* * * * *